United States Patent [19]

Watkins

[11] Patent Number: 4,920,588

[45] **Date of Patent: * May 1, 1990**

[54] MEANS PROVIDING MOVING WATER STREAM EJECTING INTO SPA TANK

[76] Inventor: Jonathan Watkins, 1004 Hopper Ave., San Marcos, Calif. 92069

[ * ] Notice: The portion of the term of this patent subsequent to Jun. 18, 2002 has been disclaimed.

[21] Appl. No.: 799,744

[22] Filed: Nov. 19, 1985

Related U.S. Application Data

[63] Continuation-in-part of Ser. No. 665,445, Oct. 26, 1984, abandoned.

[51] Int. Cl.[5] ..... A61H 33/02

[52] U.S. Cl. ..... 4/542

[58] Field of Search ..... 138/DIG. 11, 118, 119; 4/490, 492, 496, 541–544, 567–570; 239/229, 318, 426; 134/167; 128/66, 365–370

[56] References Cited

U.S. PATENT DOCUMENTS 2,748,803 6/1956 Guarnaschelli ..... 138/120 X 4,257,422 3/1981 Duncan ..... 138/118 X 4,339,833 7/1982 Mandell ..... 4/492 X 4,523,340 6/1985 Watkins ..... 4/542

*Primary Examiner*—Charles E. Phillips

*Attorney, Agent, or Firm*—Duane C. Bowen

[57] ABSTRACT

In a spa having a tank for body immersion, a flexible tube exhausting pressurized water into the tank having a free end adapted to whip usually in a vertical plane by reaction of the exhausting water. The tube has a cross-section with flattened upper and lower surfaces so the tube bends easier in the vertical plane and whips in a reciprocating motion in the vertical plane. Upper and lower limits on tube travel are formed by roller abutments that are supported by a housing. The housing has a series of holes in which the rollers are journaled extending in lines generally parallel to the tube so that the rollers can be changed in location in order to relocate upper and lower tube bending and reversing points as needed to produce effective whipping action of the tube.

10 Claims, 2 Drawing Sheets

MEANS PROVIDING MOVING WATER STREAM EJECTING INTO SPA TANK

This application is a continuation-in-part of prior U.S. application Ser. No. 665,445 filed 10/26/84.

BRIEF SUMMARY OF THE INVENTION

BACKGROUND AND OBJECTIVES

My invention relates to means to eject water, with entrained air, into a spa tank in the form of a moving water stream whipping back and forth in a single plane, particularly in a vertical plane, so that occupants can subject their bodies to the massaging action of a moving pressurized stream.

The present invention concerns improvements over my prior inventions disclosed in U.S. patent applications Ser. No. 06/243,724, filed 3/16/81, and Ser. No. 06/777,435, filed 9/18/85 and U.S. Pat. No. 4,523,340, issued 6/18/85.

More specifically, my present invention concerns means to achieve more effective or consistent whipping action. Although my concept of vertically reciprocating a jet of water in a spa through inherent whipping action of a flexible water ejecting tube is preferable to motorizing the reciprocation of a water stream, I have discovered that the whipping action is influenced by a number of variables. If whipping forces are not sufficient, the flexible tube will stall in position and produce a stationary water jet. One variable influencing whipping action is, of course, the type of material, i.e., the plastic or rubber material selected. An aspect I was surprised to discover was that even if the material selected is sophisticated or exotic and high priced, there can be enough variation in production of the material so that flexibility varies sufficiently from one batch to another to materially affect whipping operation. The apparatus needs to be adjustable to compensate for the difference in flexibility of the nozzle. Another variable is water pressure. Certain mechanical structure varies action, i.e., location of abutments. Air supply is another variable, i.e., starving of supply of air will affect whipping action. It is an objective of my invention to achieve more effective or consistent whipping action through design or control of certain of the features or variables affecting whipping action of the flexible tube. A further objective is to direct whipping action of the water exhaust tube by design of the cross-section.

My invention will be best understood, together with additional advantages and objectives thereof, when read with reference to the drawings.

THE DRAWINGS

DETAILED DESCRIPTION

Figure 1:
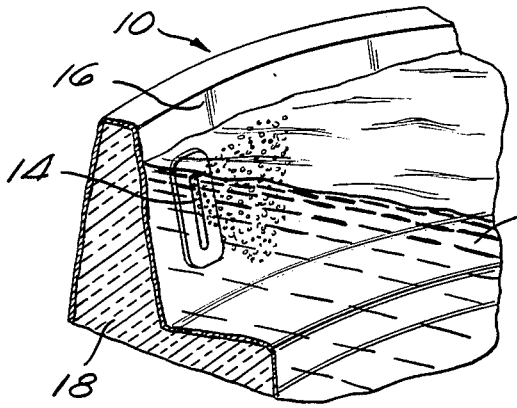
FIG. 1 is a partial perspective view of a section of a spa showing injection into the water tank of a pressurized air-water stream that reciprocates vertically.

FIG. 1 show a spa 10 having a water tank 12. A water jet is shown being injected through an opening 14 in the tank wall 16 and the water jet is depicted and reciprocating vertically. An occupant of the tank can move to a position in which the water jet plays up and down the user's spine. The interior of the walls of the spa are filled with plastic foam 18.

An outer water jet housing 20 is preferably molded in two sections 22, 24 with flanges 26, 28 bonded together. Housing 20 is suitably secured inside tank wall 16. An ABS plastic is a suitable selection from which to mold housing 20.

Water line 30 and air line 32 are suitably connected to the outer end of housing 20 by fittings 34, 36. Air line 32 is shown schematically to include a valve 38 and water line 30 is shown schematically to include a pump 39. Atmosphere air is inleted to air line 32. Lines 30, 32 can have any degree of rigidity of flexibility whereas the water tube 40 and the air tube 42 between fittings 34, 36 and nozzle 44 have to be flexible.

The selection of the best material for flexible water tube 40 has been difficult. Most elastomeric materials are too hard. Most rubbers have problems with physical properties, especially if the rubbers are of 60 durometer hardness or less. Control of rubbers is difficult including control of the durometer hardness. Abrasion resistance is important as the flexible tube 40 reciprocates between upper and lower abutments (which have been formed as rollers to reduce abrasion). The best material that has been found thus-far is General Electric silicone rubber TUF-EL 40 (40 durometer hardness), although it is expensive relative to other materials considered. TUF-EL 40 is an exceptional silicone because most silicones don't have good abrasion resistance but this General Electric silicone does.

I have conceived of the idea of making the flexible water tube 40 flex more easily (requiring less force) in a first plane, usually a vertical plane, than a plane 90° thereto, usually a horizontal plane, whereby it will tend to reciprocate in the first plane without external guidance. To make tube 40 more flexible in the first plane than the second plane, i.e., more flexible vertically than horizontally, could be done in a number of ways. My preferred construction essentially provides more material of the tubular nozzle in a first plane (the horizontal plane as viewed) than in a second plane (the vertical plane as viewed), whereby the nozzle will bend more easily in the first or vertical plane than in the second or horizontal plane and will tend to whip in the first vertical plane.

Figure 6:
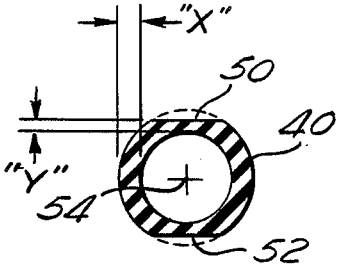
FIG. 6 is a cross-sectional view of the water tube.

More specifically, FIG. 6 shows a cross-section of the specific embodiment of the nozzle illustrated and described herein. The tube 40 may be described as viewed as a circular annulus modified by flattened upper and lower surfaces 50, 52. A normal circular tube contour is indicated by dashed lines. The flattened areas 50,52 can be achieved by removal of material from a circular annulus or can be achieved by original molding or extrusion with flattened areas 50, 52. It will be seen that the side wall thicknesses "x" are greater than the upper and lower wall thicknesses "y". It is also significant that the "missing" material vertically is the farthest from the center 54, i.e., if the "missing" material were instead closer to the center 54, bending in the vertical plane would take more force. In the prototype, the wall thickness of tube 40 in flattened spots 50,52 was reduced from around 0.220 inches ("x" dimension) to around 0.150 inches ("y" dimension).

This has proven to be effective to give tube 40 a tendency to reciprocate in the first vertical plane. To go from 0.220" to 0.150" in wall thickness is about a 31.8% reduction in wall thickness and it is preferred to reduce the wall thickness at least 20%.

I have shown tube 40 to reciprocate in a vertical plane. However, it could reciprocate in a horizontal or an oblique plane, depending on whether upper and lower, side or oblique tube walls were flattened at 50,52. Most often, however, the installation of tube 40 will be directed to reciprocate tube 40 in a vertical plane.

Figure 2:
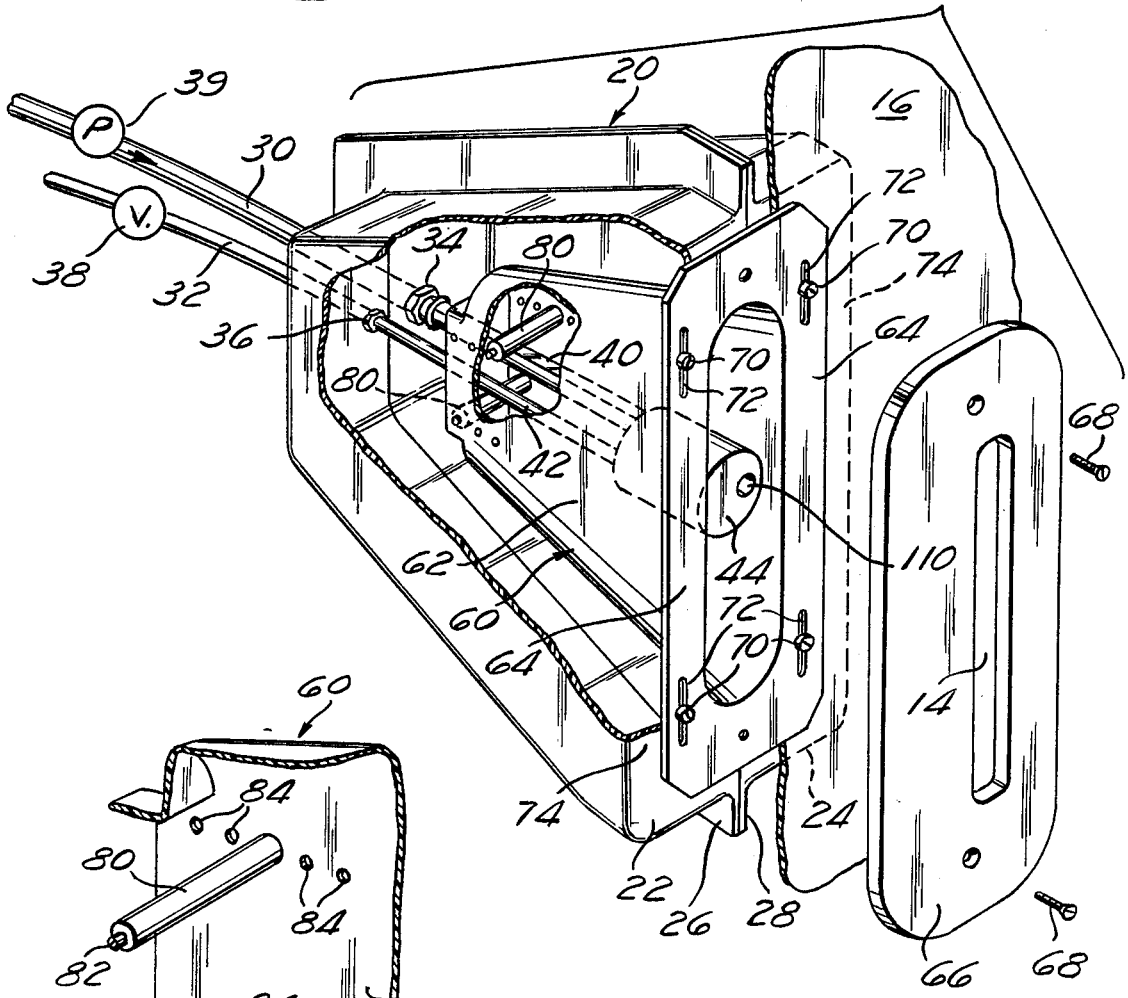
FIG. 2 is an enlarged perspective view, with some parts in exploded position and with housing portions broken away to reveal interior structures.
Figure 4:
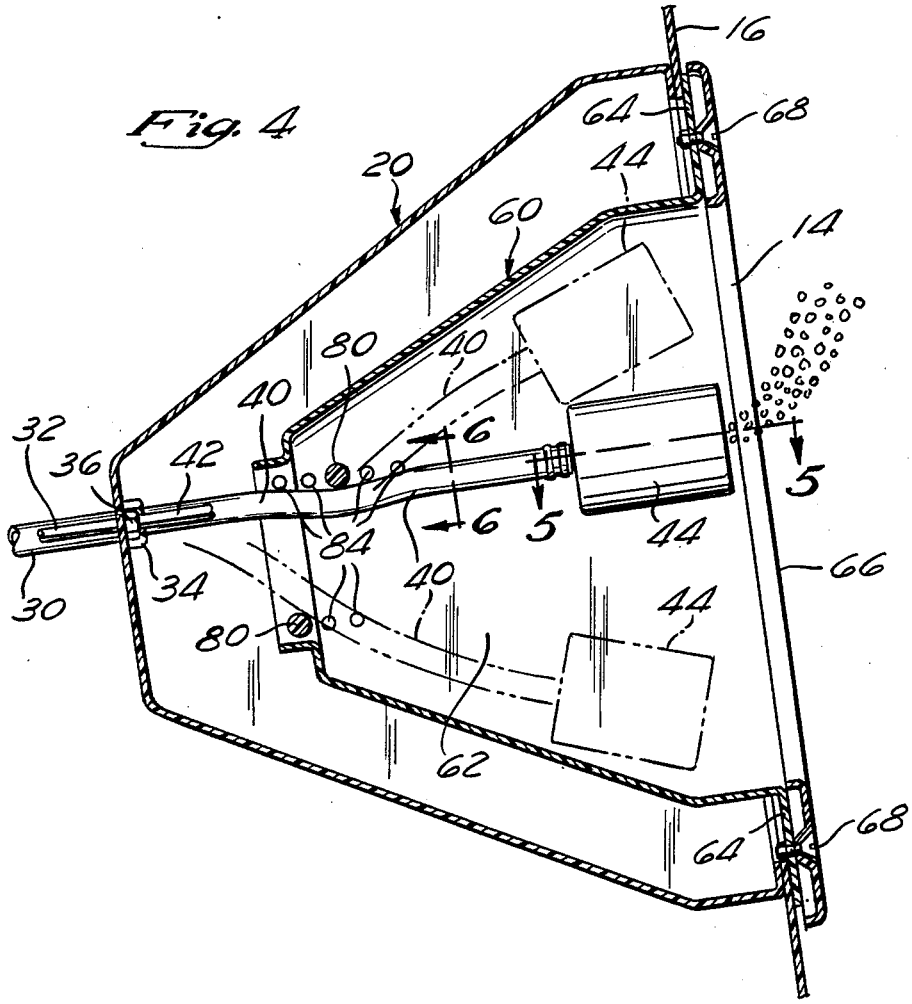
FIG. 4 is a side view, partly in section. The flexible tube and nozzle are shown in upper, lower and intermediate positions.

As illustrated in FIGS. 2 and 4, usually the installation of tube 40 will be directed so that the front spa wall 16 is substantially vertical and the medial position of tube 40 (between upper and lower limits of travel) is more or less horizontal. That is the most difficult position to maintain reciprocating motion of tube 40. As wall 16 becomes more and more inclined to the vertical or even becomes horizontal and as the medial position of tube 40 becomes more oblique or even becomes vertical, maintaining reciprocating motion of tube 40 becomes easier. Perhap this is because gravity becomes less of a factor.

An inner housing 60 is disposed inside outer housing 20. Both housings preferably flare inwardly, to somewhat match the pattern of the path of travel of tube 40. The sides 62 of inner housing 60 form guides or limits on movement of tube 40 and nozzle 44 out of vertical travel. However, the guiding function of sidewalls 62 may not be needed if the cross-section of tube 40 shown in FIG. 6 is utilized. Preferably inner housing 60 is made of high density polyethylene, which provides a slick wear-resistant surface which would be desirable particularly if the sides of nozzle 44 were to ride therealong in a guiding function of inner housing 60.

Inner housing 60 has flanges 64 which are sandwiched relative to tank wall 16 and to a face plate 66 (in which opening 14 is formed). Face plate 66 is secured to the flanges 64 of inner housing 60 by fasteners 68. Inner housing 60 is vertically adjustable relative to outer housing 20 by means of fasteners 70 which are disposed in vertically extending slots 72 in flanges 64. Fasteners 70 secure in tank wall 16 and/or in flanges 74 at the end of outer housing 20. By means of vertical slots 72 and fasteners 70, inner housing 60 can be adjusted vertically relative to outer housing 20. This permits vertical adjustment of abutments 80 which form limits on whipping motion of flexible water tube 40.

Abutments 80 have the form of rollers with reduced diameter ends 82 that fit in holes 84. Rollers are used rather than fixed abutments in order to reduce abrasion on water tube 40. With materials that are presently used for water tube 40, abrasion would be unacceptable if abutments 80 didn't roll.

When water tube 40 strikes one of the abutments 80, tubes 40 42 reverse direction by a reversing S-curve or undulating type movement.

Figure 3:
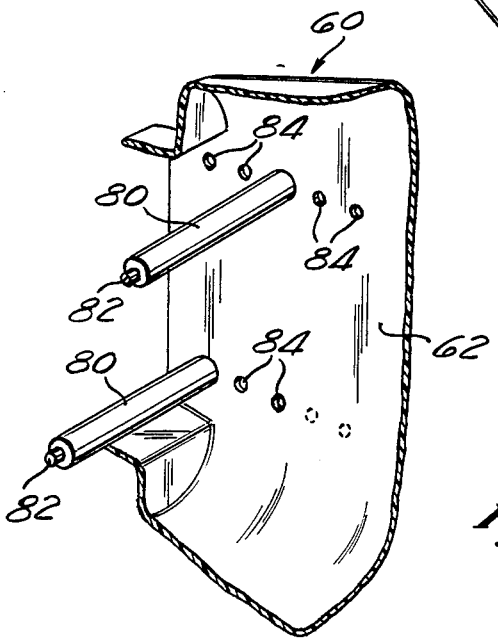
FIG. 3 is a perspective view of a portion of the interior housings showing a series of holes to support abutment rollers in various positions.

The reliability of reciprocation of tube 40 (as against stalling in some position) as well as speed of reciprocation, to some extent, depend partly on the location of abutments 80. Vertical adjustment of abutments (laterally of tube 40) was previously specified in my U.S. Pat. No. 4,523,340, issued 6/15/85, but new to the present patent application is adjustment of abutments 80 horizontally (primarily longitudinally of tube 40). The locations of abutments 80 that usually work best are to journal the lower abutment 80 in the first pair of holes 84 from the left as viewed in FIG. 3 and to journal the upper abutment 80 in the third pair of holes from the left as viewed in FIG. 3. The location of abutments 80 is more of an art than a science and involves several relationships but it could appear that the reason upper abutment should be located differently from lower abutment is gravity. Note from FIG. 4 that fittings 34,36 are closer to the level of upper abutment 80 than to the level of lower abutment 80, and the influence of gravity on tubes 40,42 and on nozzle 44 would seem to be a reason for this preferred location (along with the influence of any buoyancy of nozzle 44 and air tube 42, etc.) According to this reasoning, as housing 20 is shifted in position from the one shown in which face plate 66 is primarily vertical towards a position in which face plate 66 is horizontal or more nearly horizontal, it would seem the best locations for the two abutments should change. If face plate 66 were horizontal, it would seem abutments 80 should be located corresponding holes 84 if fittings 34,36 were located equally distant from the two lines of holes 84.

There would be other ways to journal upper and lower abutments so that their rotatable supports could be adjusted longitudinally of tube 40 but the use of multiple holes 84 is an economical and satisfactory way to adjustably and differentially support upper and lower rollers 80. The most economical way to accommodate change of positions of rollers 80 from one set of openings 84 to another set of openings 84 is to flex the sides 62 of inner housing 60. Another way would be to provide at least one of the reduced diameter ends of rollers 80 with a slidable spring-pressed construction (like is sometimes found in the roller of a bathroom tissue holder). Dashed lines in FIG. 3 indicate additional openings 84 can be drilled as needed.

Figure 5:
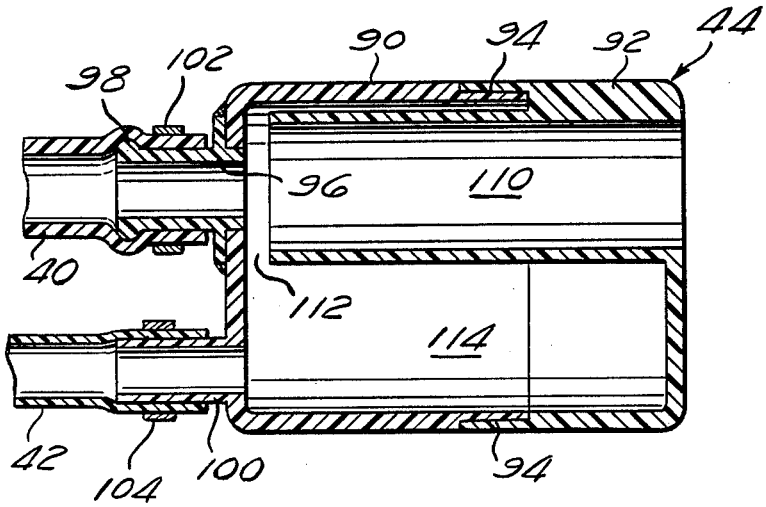
FIG. 5 is an enlarged side view, partly in section, of the nozzle and the attachment of water and air tubes thereto.

The nozzle construction is detailed in FIG. 5. This is a three-piece molded construction including left and right shells 90,92 interfitting at 94 by lapping larger and smaller diameters. The nipple 96 for connection of the water tube 40 is also molded separately because the annular bead 98 prevents molding as a part of left shell 90. Nipple 100 for air tube 40 is molded as part of left shell 90 because it is unbeaded. The reason for annular beading of nipple 96 is that the water stream going through tube 40 is pressurized and bead 98 is needed in addition to an annular clamps 102. In the case of nipple 100, an annular clamp 104 is sufficient without beading because the air in tube 42 is unpressurized (inleted from the atmosphere). Nozzle parts 90,92, 96 are bonded together.

Right shell 90 has an exhaust tube 110 directed toward nipple 96 but spaced therefrom so that air can be drawn in a Venturi or vacuum manner through the gap 112 between tube 110 and nipple 96 from the remainder of the cavity formed by shells 90,92 which forms an air chamber 114 fed by air from tube 42. Presence of air in chamber 114 gives nozzle 40 buoyancy.

Having thus described my invention, I do not wish to be understood as limiting myself for the exact construction shown and described. Instead, I wish to cover these modifications of my invention that will occur to those skilled in the art upon learning of my invention and which are within the proper scope thereof.

I claim:

1. The improvement in a spa or the like, comprising:

(a) a tank containing water for body immersion and a flexible tube directed to exhaust water into said tank from a side thereof and a source of pressurized water connected to said tube, said tube having a free end adapted to whip by reaction of water exhausting therefrom for massage of users, said tube being annular in cross-section with a wider horizontal thickness and a narrower vertical thickness whereby said tube tends to bend around horizontal axes and to travel in a vertical plane, and (b) said tube having a portion fixedly secured relative to said tank with said free end extending inwardly therefrom towards the inside of said tank and an upper and a lower abutment positioned respectively above and below said tube forming upper and lower bending points above and below said tube and spaced from said fixedly secured portion of said tube in a direction generally inwardly relative to said tank, said abutments being rollers to minimize tube abrasion and there being separate support means operative to rotatably support each roller, said support means for each roller being operative to independently support each roller at a number of locations at different distances relative to said fixedly secured portion generally horizontally and inwardly relative to said tank thereby to relocate the upper and lower bending points as needed to produce effective whipping action of said tube.

2. The improvement in a spa or the like, comprising:

(a) a tank containing water for body immersion and a flexible tube directed to exhaust water into said tank and a source of pressurized water connected to said tube, said tube having a free end adapted to whip in a first plane by reaction of water exhausting therefrom for massage of users, said tube being annular in cross-section with a wider thickness in a second plane at right angles to said first plane and a narrower thickness in said first plane whereby said tube tends to bend around axes in said second plane and to travel in said first plane, and (b) said tube having a portion fixedly secured relative to said tank with said free end extending inwardly therefrom towards the inside of said tank and a pair of abutments positioned on opposite sides of said tube in said first plane forming bending points on opposite sides of said tube and spaced from said fixedly secured portion of said tube in a direction generally inwardly relative to said tank, said abutments being rollers to minimize tube abrasion and there being separate support means operative to rotatably support each roller, said support means for each roller being operative to independently support each roller at a number of locations at different distances relative to said fixedly secured portion inwardly relative to said tank thereby to relocate said bending points as needed to produce effective whipping action of said tube.

3. The improvement in a spa or the like, comprising:

(a) a tank containing water for body immersion and a flexible tube directed to exhaust water into said tank from a side thereof and a source of pressurized water connected to said tube, said tube having a free end adapted to whip by reaction of water exhausting therefrom for massage of users, said tube having a wider horizontal thickness and a narrower vertical thickness whereby said tube tends to bend around horizontal axes and to travel in a vertical plane, and (b) said tube having a portion fixedly secured relative to said tank with said free end extending inwardly therefrom towards the inside of said tank and an upper and a lower abutment positioned respectively above and below said tube forming upper and lower bending points above and below said tube and spaced from said fixedly secured portion of said tube in a direction generally inwardly relative to said tank, there being separate support means for each abutment operative to independently support each abutment at a number of locations at different distances relative to said fixedly secured portion generally horizontally and inwardly relative to said tank thereby to relocate the upper and lower bending points as needed to produce effective whipping action of said tube.

4. The improvement in a spa or the like, comprising:

a tank containing water for body immersion and a flexible tube having a portion fixedly secured relative to said tank and said flexible tube being directed to exhaust water into said tank from a side thereof and a source of pressurized water connected to said tube, said tube having a free end adapted to whip by reaction of water exhausting therefrom for massage of users, said tube in cross-section having a wider horizontal thickness and a narrower vertical thickness whereby said tube tends to bend around horizontal axes and to travel in a vertical plane rather than other planes during whipping movement.

5. The subject matter of claim 4 in which said cross-section of said tube is in the form of a curved annulus modified by flattened upper and lower surfaces.

6. The improvement in a spa or the like, comprising:

(a) a tank containing water for body immersion and a flexible tube directed to exhaust water into said tank from a side thereof and a source of pressurized water connected to said tube, said tube having a free end adapted to whip by reaction of water exhausting therefrom for massage of users, (b) said tube having a portion fixedly secured relative to said tank with said free end extending inwardly therefrom towards the inside of said tank and an upper and a lower abutment positioned respectively above and below said tube forming upper and lower bending points above and below said tube and spaced from said fixedly secured portion of said tube in a direction generally inwardly relative to said tank, there being separate support means for each abutment operative to independently support each abutment at a number of locations at different distances relative to said fixedly secured portion generally horizontally and inwardly relative to said tank thereby to relocate the upper and lower bending points as needed to produce effective whipping action of said tube.

7. The subject matter of claim 6 in which said abutments are upper and lower rollers to minimize tube abrasion and said separate support means being operative to rotatably support each roller, each separate support means having the form of a series of spaced holes operative to rotatably support each roller, each series to holes extending horizontally at different distances relative to said fixedly secured portion of said tube.

8. The improvement in a spa or the like, comprising:

(a) a tank containing water for body immersion and a flexible tube directed to exhaust water into said tank and a source of pressurized water connected to said tube, said tube having a free end adapted to whip in a vertical plane by reaction of water exhausting therefrom for massage of users, (b) said tube having a portion fixedly secured relative to said tank with said free end extending inwardly therefrom towards the inside of said tank and at least one abutment positioned respectively on one side of said tube in said vertical plane forming a bending point on said one side of said tube and spaced from said fixedly secured portion of said tube in a direction generally inwardly relative to said tank, there being support means for said abutment operative to support said abutment at a number of locations at different distances inwardly relative to said tank thereby to relocate said bending point as needed to produce effective whipping action of said tube.

9. The improvement in a spa or the like, comprising: a tank containing water for body immersion and a flexible tube having a portion fixedly secured relative to said tank and said flexible tube being directed to exhaust water into said tank from a side thereof and a source of pressurized water connected to said tube, said tube having a free end adapted to whip by reaction of water exhausting therefrom for massage of users, said tube being, by inherent property of said tube, more flexible in a vertical plane extending longitudinally of said tube than horizontally whereby said tube tends to whip in said vertical plane rather than other planes during whipping movement.

10. The improvement in a spa or the like, comprising: a tank containing water for body immersion and a flexible tube having a portion fixedly secured relative to said tank and said flexible tube being directed to exhaust water into said tank from a side thereof and a source of pressurized water connected to said tube, said tube having a free end adapted to whip by reaction of water exhausting therefrom for massage of users, said tube being more flexible in a first plane extending longitudinally of said tube than transversely of said first plane whereby said tube tends to whip in said first plane rather than other planes during whipping movement.

* * * * *